US009869113B2

(12) United States Patent
Janssen et al.

(10) Patent No.: US 9,869,113 B2
(45) Date of Patent: Jan. 16, 2018

(54) VEHICLE LOCK

(71) Applicant: WITTE Automotive GmbH, Velbert (DE)

(72) Inventors: Thorsten Janssen, Velbert (DE); Bernd Gellhaus, Bochum (DE); Matthias Wiemann, Bochum (DE); Stefanie Angelkorte, Selm (DE); Tsevetelina Stoycheva, Ruse (BG)

(73) Assignee: WITTE AUTOMOTIVE GMBH, Velbert (DE)

( * ) Notice: Subject to any disclaimer, the term of this patent is extended or adjusted under 35 U.S.C. 154(b) by 254 days.

(21) Appl. No.: 14/472,711

(22) Filed: Aug. 29, 2014

(65) Prior Publication Data

US 2015/0184432 A1 Jul. 2, 2015

(30) Foreign Application Priority Data

Sep. 2, 2013 (EP) ..... 13182616

(51) Int. Cl.

| | |
|---|---|
| ***E05C 3/06*** | (2006.01) |
| ***E05B 85/20*** | (2014.01) |
| ***E05B 81/14*** | (2014.01) |
| *E05B 79/20* | (2014.01) |
| *E05B 81/06* | (2014.01) |

(52) U.S. Cl.

CPC ..... *E05B 85/20* (2013.01); *E05B 81/15* (2013.01); *E05B 79/20* (2013.01); *E05B 81/06* (2013.01); *Y10T 292/108* (2015.04)

(58) Field of Classification Search

CPC ..... E05B 81/14; E05B 81/16; E05B 81/18; E05B 81/15; E05B 85/20

USPC ..... 292/200

See application file for complete search history.

(56) References Cited

U.S. PATENT DOCUMENTS

| | | | | |
|---|---|---|---|---|
| 2003/0038485 | A1 | 2/2003 | Schwaiger et al. | |
| 2006/0006671 | A1* | 1/2006 | Noel | E05B 77/26 292/216 |
| 2006/0202488 | A1* | 9/2006 | Kunst | E05B 81/14 292/216 |
| 2006/0267350 | A1* | 11/2006 | Ichinose | E05B 81/14 292/201 |

(Continued)

FOREIGN PATENT DOCUMENTS

| | | | |
|---|---|---|---|
| DE | 19619958 | A1 | 11/1997 |
| DE | 69908037 | T2 | 4/2004 |

(Continued)

OTHER PUBLICATIONS

WITTE Automotive GMBH, European Search Report, EP 13 18 2616, dated Mar. 24, 2014, pp. 1-3, English translation.

*Primary Examiner* — Mark Williams

(74) *Attorney, Agent, or Firm* — Cislo & Thomas, LLP; Kenneth D'Alessandro

(57) ABSTRACT

A motor vehicle lock in accordance with the invention comprises a pivotable catch having a jacket surface, a pawl which is acted on by a preloading force and which is pivotable between a blocking position in which the pawl blocks the catch and an unblocking position in which the catch is unblocked, a release lever for pivoting the pawl against the preloading force, and an arresting device for arresting the pawl in a release position in which it releases the catch, wherein a part of the arresting device is formed by the release lever.

13 Claims, 8 Drawing Sheets

(56) References Cited

U.S. PATENT DOCUMENTS

Figure 1:
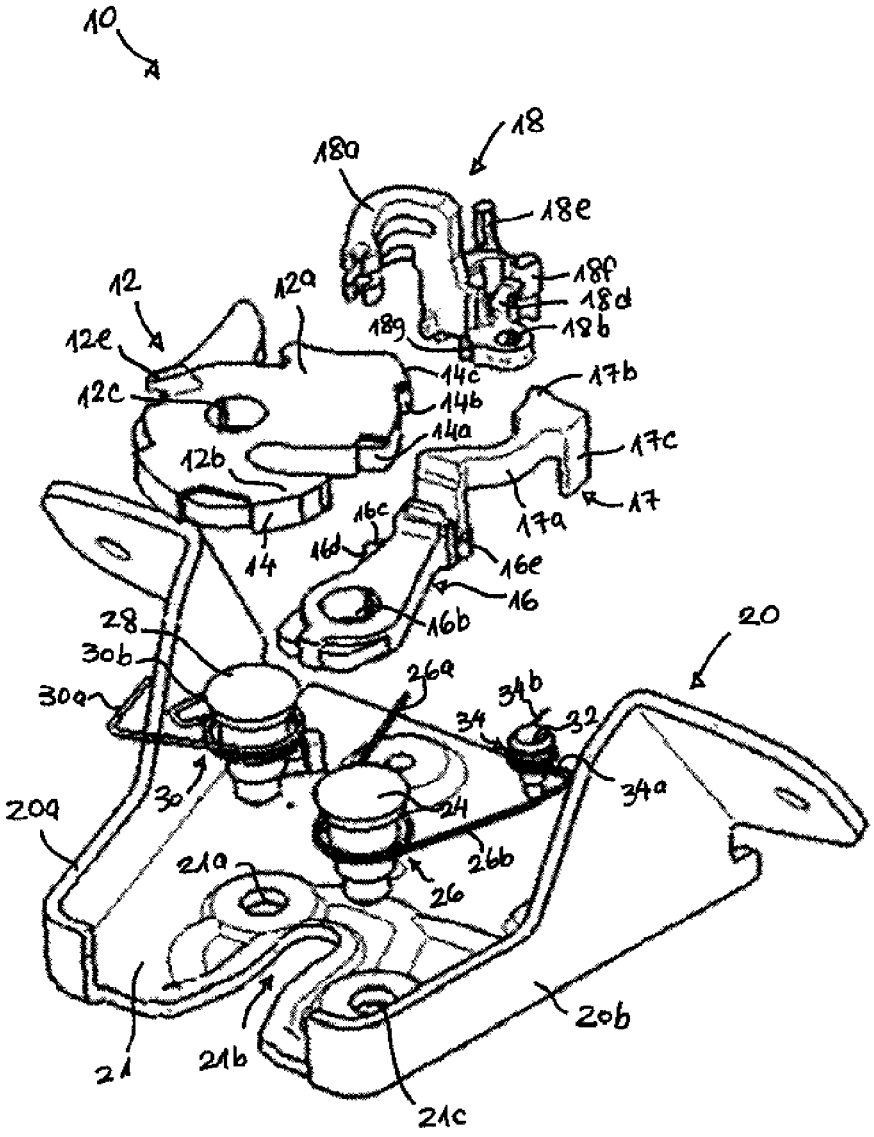

| | | | | |
|---|---|---|---|---|
| 2007/0029814 | A1* | 2/2007 | Coleman | E05B 81/14 292/201 |
| 2007/0205613 | A1* | 9/2007 | Berghahn | E05B 81/20 292/216 |
| 2011/0204659 | A1 | 8/2011 | Estrada et al. | |

FOREIGN PATENT DOCUMENTS

| | | | |
|---|---|---|---|
| DE | 10361168 | A1 | 7/2005 |
| DE | 102007045716 | A1 | 4/2008 |
| DE | 102007024672 | A1 | 11/2008 |
| FR | 2804713 | | 8/2001 |
| GB | 2457680 | A | 8/2009 |

* cited by examiner

VEHICLE LOCK

CROSS-REFERENCE TO RELATED APPLICATIONS

The present Application claims priority from European Patent Application No. 13182616.6 filed Sep. 2, 2013, the contents of which are incorporated herein by reference in their entirety.

The invention relates to a motor vehicle lock having a pawl arrest.

Such motor vehicle locks are generally known, e.g. for locking tailgates, hoods and doors, and comprise a spring-loaded catch which locks a striker or a cotter in a closed position and a spring-loaded pawl which blocks a jacket surface of the catch in a blocking position. A driver having a latch connection element is arranged at the pawl and cooperates with a counter-latch connection element arranged at an end face of the catch to arrest the pawl. It is prevented by this pawl arresting that the pawl pivots back into the blocking position and blocks the catch when the catch does not leave its closed position. Since the pawl cooperates both with the jacket surface and with the counter-latch connection element arranged at the end face, the functional mechanism of the motor vehicle lock is complicated, however.

It is therefore the underlying object of the invention to provide a motor vehicle lock having a simple functional mechanism.

A motor vehicle lock having the features of claim 1 is provided to satisfy the object.

The motor vehicle lock in accordance with the invention comprises a pivotable catch having a jacket surface, a pawl which is acted on by a preloading force and which is pivotable between a blocking position in which the pawl blocks the catch and an unblocking position in which the catch is unblocked, a release lever for pivoting the pawl against the preloading force, and an arresting device for arresting the pawl in a release position in which it releases the catch, wherein a part of the arresting device is formed by the release lever. In other words, the pawl arresting does not take place by a latch connection between the pawl and the catch, but rather by the trigger lever in engagement with the pawl. The arresting of the pawl acting by means of an elastic driver and in the end face direction of the catch is thus dispensed with.

Since the pawl is arrested by the release lever, the pawl can furthermore be arrested up to the complete opening of the catch, whereby an uncontrolled pivoting of the pawl when the catch is opening can be prevented.

Advantageous embodiments of the invention can be seen from the dependent claims, from the description and from the drawing.

In accordance with an advantageous embodiment, the release position of the pawl is located between the blocking position and the unblocking position. The release position, blocking position and unblocking position each represent a different angular position of the pawl so that the release position is located within the range of movement of the pawl, that is between the blocking position and the unblocking position of the pawl. A compact design of the motor vehicle lock thus becomes possible.

In accordance with a preferred embodiment, the catch comprises a link for releasing the pawl from the release position, whereby an additional device for releasing the arresting device can be omitted. The link can particularly advantageously be arranged at the jacket surface of the catch for releasing the arresting device.

In a further advantageous embodiment, the catch only moves into functionally effective contact with the pawl via its jacket surface. This means that the pawl only blocks the catch by means of a contact between the pawl and the jacket surface of the pawl and the pawl also releases the pawl from its release position by means of a contact between the pawl and the jacket surface of the catch. A cooperation of the catch and of the pawl via an end face of the catch can thus be omitted, for example, whereby a larger design freedom of the motor vehicle lock arises.

The release lever can furthermore have a transport cam which pivots the pawl over a cam arranged at the pawl into the unblocking position. On the pivoting of the release lever, the transport cam is moved toward the pawl, for example by a drive motor or also manually, to pivot the pawl into the unblocking position. The transport cam can in this respect particularly simply be designed as a block-shaped projection at the release lever.

In a further preferred embodiment, the release lever has a driver cam via which the release lever pivots the pawl out of the blocking position. This means that the pawl is first moved out of the blocking position via the driver cam until a transport cam of the release lever is moved toward the cam of the driver. The pivot movement of the driver is then transferred from the driver cam onto the transport cam, whereby the release lever can have a compact design.

In accordance with the invention, the arresting device can have a latch connection between the cam of the pawl and the transport cam, whereby a secure arresting of the pawl as well as a secure release of the arresting device becomes possible.

In accordance with a further advantageous embodiment, the jacket surface of the catch has a blocking section which cooperates with a latching section of the pawl in the blocking position of the pawl, a prelatching section which cooperates with the latching section of the pawl in a prelatching position of the pawl, and a support section which cooperates with a support surface of the pawl in the unblocking position of the pawl. The motor vehicle lock can still, for example, lock a motor vehicle door after an initial actuation due to the prelatching section so that an unintentional opening of the motor vehicle door can be prevented. Furthermore, the blocking section, the prelatching section and the support section can be arranged one after the other at the jacket surface of the catch.

A complete opening of the catch is ensured in a particularly simple manner when the pawl is located in an overlifting position in the release position. To reach the overlifting position, the pawl is, for example, pivoted against the preloading force so much that the blocking section and/or the prelatching position of the catch do/does not come into contact with the latching section of the pawl on a pivoting of the pawl.

In a further preferred embodiment, the release lever has a blocking cam which blocks the pawl against a pivoting against the preloading force in the blocking position and/or in the prelatching position. In other words, the pawl can only be pivoted out of the blocking position or the prelatching position when the release lever is pivoted against its preloading force. It is therefore prevented by the blocking cam of the release lever that the pawl accidently leaves the blocking position or prelatching position.

A housing of the motor vehicle lock can be built in a particularly compact manner in that a part of the pawl projects through a window formed in the housing in the release position.

Figure 2:
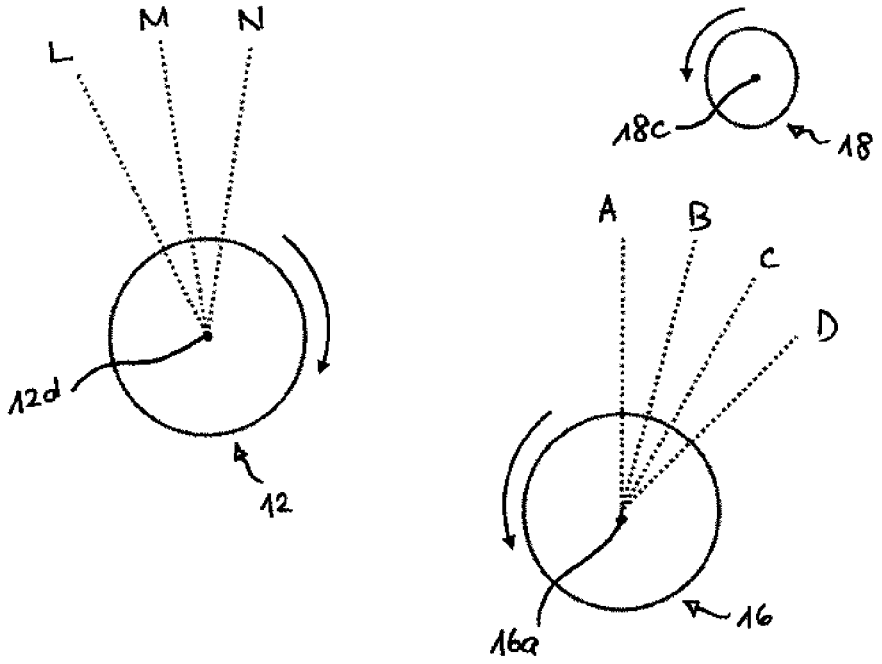
Figure 3A:
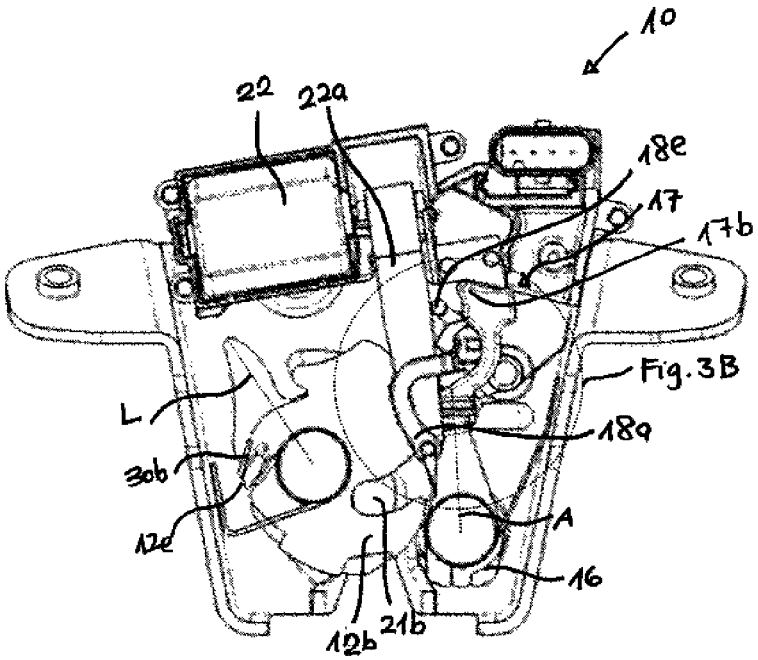
Figure 3B:
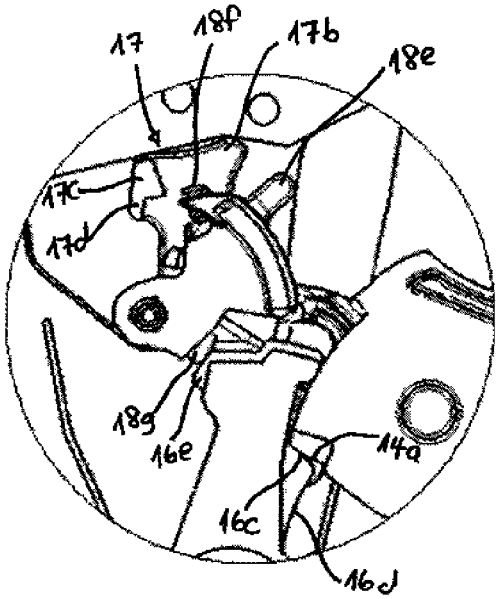
Figure 4A:
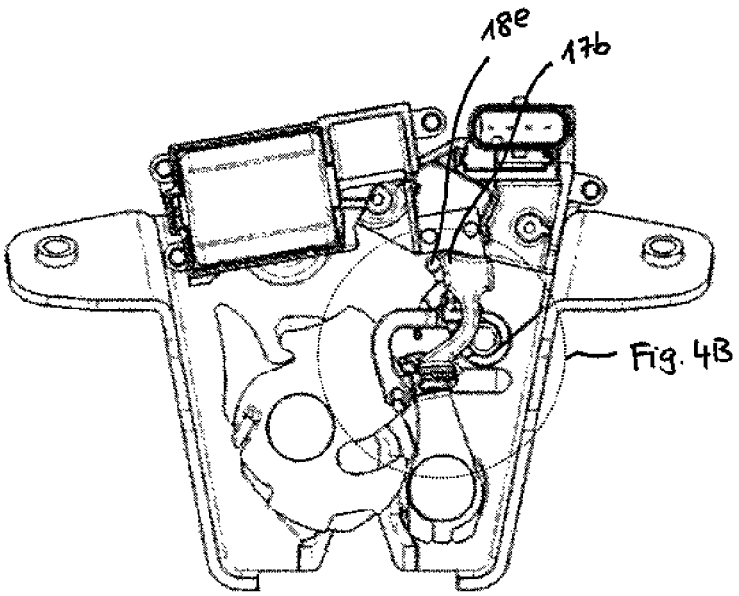
Figure 4B:
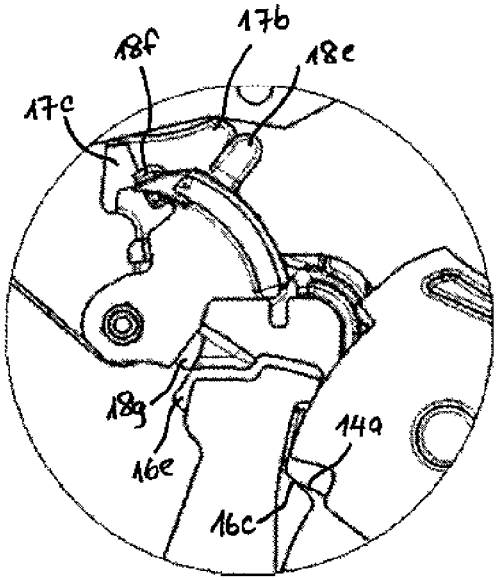
Figure 5A:
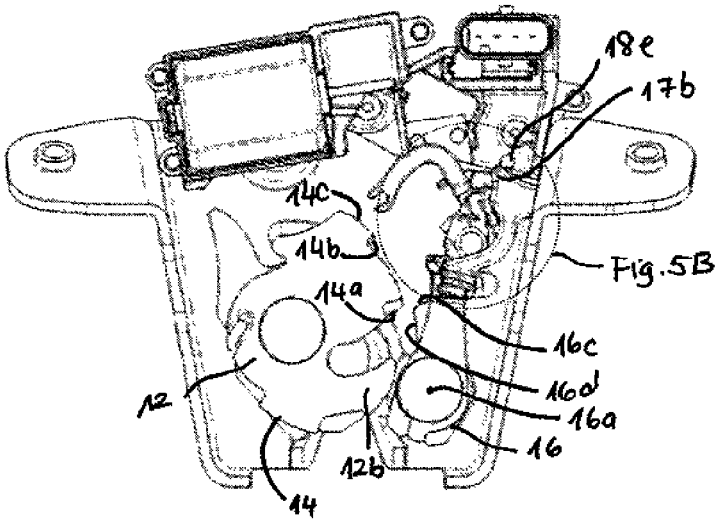
Figure 5B:
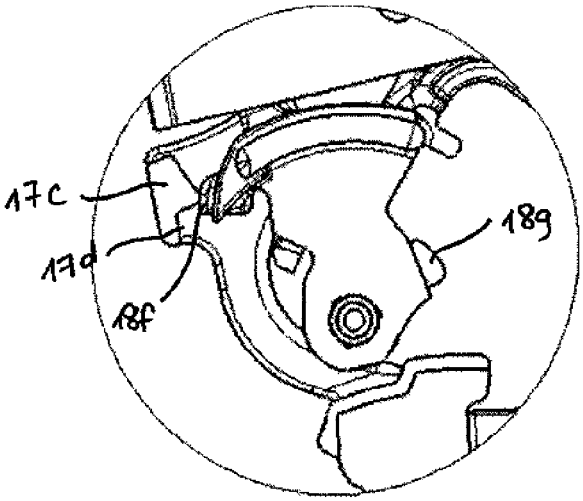
Figure 6A:
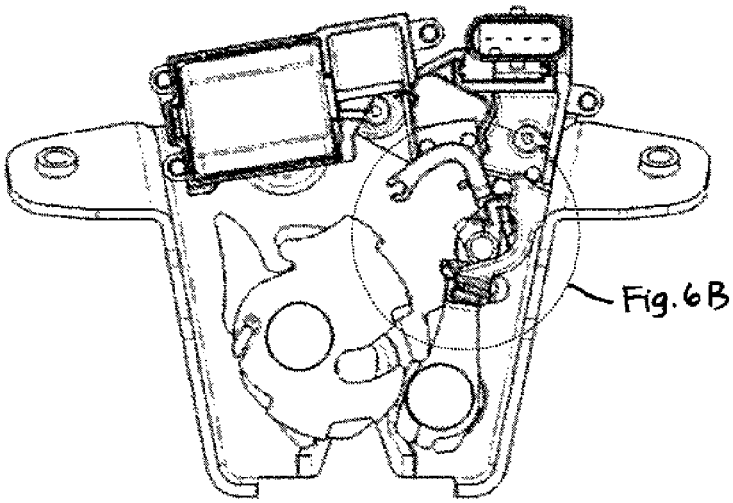
Figure 6B:
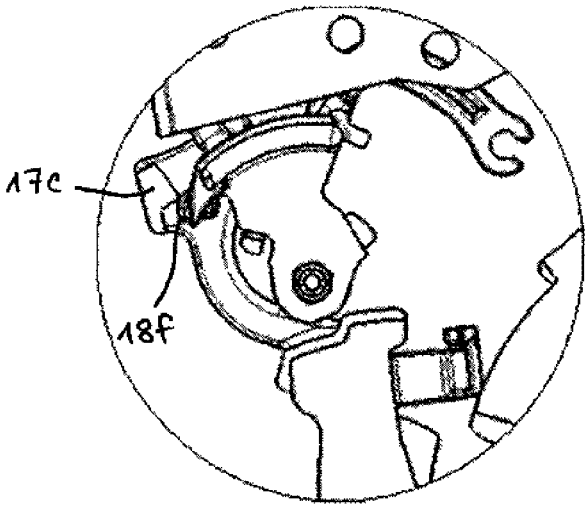
Figure 7A:
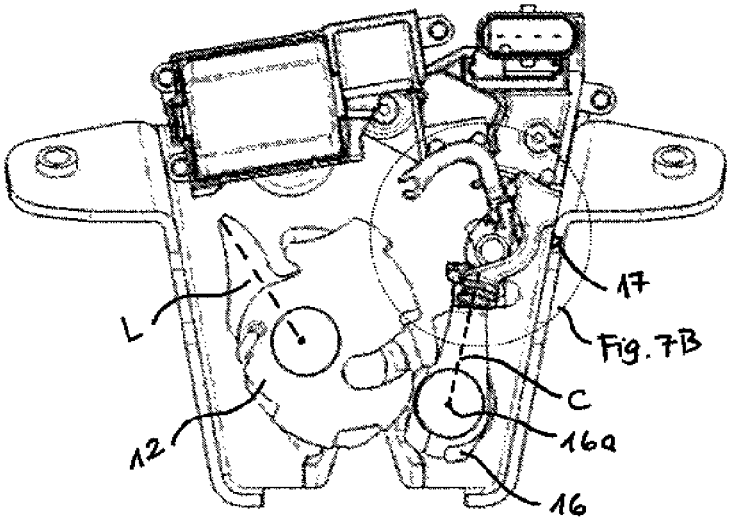
Figure 7B:
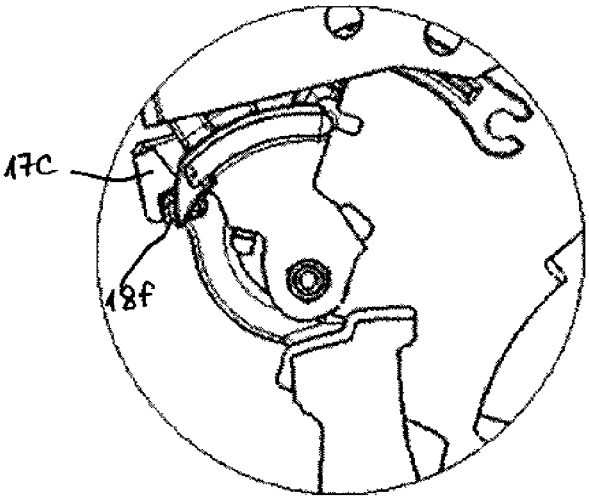
Figure 8A:
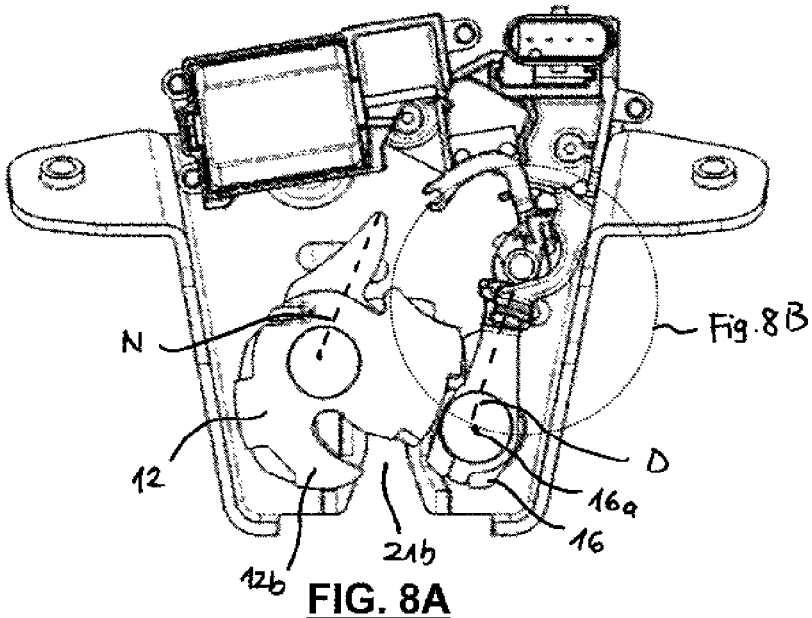
Figure 8B:
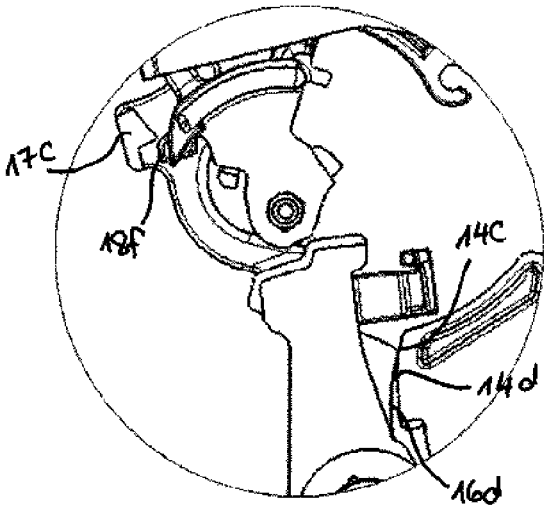

An exemplary embodiment of the invention will be described in the following with reference to the enclosed drawing. There are shown:

FIG. 1 an exploded representation of a motor vehicle lock in accordance with the invention;

FIG. 2 a schematic representation of the motor vehicle lock in FIG. 1;

FIGS. 3A and 3B a front view and an enlarged rear view of the motor vehicle lock having a pawl in a blocking position and having a catch in a closed position;

FIGS. 4A and 4B a front view and an enlarged rear view of the motor vehicle lock in FIG. 3 at the start of an opening process;

FIGS. 5A and 5B a front view and an enlarged rear view of the motor vehicle lock in FIG. 3 during an opening process;

FIGS. 6A and 6B a front view and an enlarged rear view of the motor vehicle lock in FIG. 3 during the opening process;

FIGS. 7A and 7B a front view and an enlarged rear view of the motor vehicle lock in FIG. 3 with the pawl in a release position and with the catch in the closed position; and FIGS. 8A and 8B a front view and an enlarged rear view of the motor vehicle lock in FIG. 3 with the pawl in the unblocking position and with the catch in an open position.

FIG. 1 shows an embodiment of a motor vehicle lock 10 in accordance with the invention for locking a motor vehicle tailgate, not shown, at a vehicle body. For example, the motor vehicle lock 10 is mounted at a rim of a trunk and locks a tailgate via a striker mounted at an inner side of the tailgate. The vehicle lock 10 and the striker can naturally be mounted in a reverse order at the trunk and at the tailgate. In addition, the motor vehicle lock 10 can also be used for locking a hood or doors of a motor vehicle.

The motor vehicle lock 10 comprises a pivotable catch 12 having a jacket surface 14 formed at the outer periphery, a pivotable pawl 16, a release lever 18 for pivoting the pawl 16, as well as an arresting device for arresting the pawl 16 in a release position in which it releases the catch 12. The motor vehicle lock 10 furthermore comprises a housing 20 having a base plate 21 which comprises a left side wall 20*a* at one side and a right side wall 20*b* at an oppositely disposed side.

The catch 12 of the motor vehicle lock 10 is configured as a flat, approximately round disk having end faces 12*a* which are connected by the jacket surface 14. The catch 12 furthermore comprises a fork section 12*b* which engages through an eyelet of the striker in a closed position of the catch 12 for locking the tailgate.

To block the catch 12 in the closed position, the pawl 16 cooperates with a blocking section 14*a* which is formed by a latch nose and which is arranged opposite the fork section 12*b* at the jacket surface 14 of the catch 12 (cf. FIG. 3). A prelatching section 14*b* is furthermore arranged at the jacket surface 14, said prelatching section being formed by a latch nose and cooperating with the catch 12 to block the catch 12 in a preclosed position M. In this respect, the blocking section 14*a* and the prelatching section 14*b* of the jacket surface 14 extend in a direction approximately radial to the pivot axis 12*d* (cf. FIG. 5A).

The jacket surface 14 comprises a support section 14*c* which represents a section of the jacket surface 14 arranged approximately tangentially to the pivot axis 12*d* (cf. FIG. 5A). If the catch 12 opens to release the striker, the support section 14*c* presses against the pawl 16 and holds the pawl 16 in an unblocking position D (cf. FIG. 8B). A link 14*d* is moreover arranged beside the support section 14*c* to release the arresting device in a radial direction of the catch 12.

The catch 12 is pivotably supported about a pivot axis 12*d* (cf. FIG. 2) at the base plate 21 of the housing 20 by a pin 28 which engages through an eccentric opening 12*c* of the catch 12 and through an opening 21*a* formed in the base plate 21. A leg spring 30 is wound around the pin 28, with a first leg 30*a* of the leg spring 30 contacting the left side wall 20*a* of the housing 20, whereas a second limb 30*b* is anchored at a projection 12*e* of the catch 12 arranged at the end face 21*a* (cf. FIG. 3A). The leg spring 30 acts on the catch 12 with a preloading force which pivots the catch 12 clockwise to unlock the striker, as will be explained in more detail with reference to FIG. 2.

As already described, the pawl 16 cooperates with the jacket surface 14 of the catch 12 to block the catch 12. For this purpose, the pawl 16 has a latching section 16*c* and a support section 16*d* which are each formed on oppositely disposed sides of a triangular projection, with the latching section 16*c* being arranged in a direction approximately tangential to the pivot axis 16*c* and the support surface being arranged in a direction approximately radial to the pivot axis 16*a* (cf. FIG. 5A). The pawl 16 pivots in the direction of the catch 12 due to the preloading force of the leg spring 26 so that the latching section 16*c* of the pawl 16 engages the catch via the blocking section 14*a* or via the prelatching section 14*b* and blocks the catch 12 (cf. FIG. 3B).

To raise the pawl 16, the driver 17 is arranged at an end of the pawl 16 disposed opposite the pivot axis 16*a*. The driver 17 projects from the pawl 16 in a direction parallel to the pivot axis 16*a* and has a curved section 17*a*. The driver 17 has a rounded driver edge 17*b* and a cam 17*c* at an end of the curved section 17*a* remote from the pivot axis 16*a*, which driver edge and cam serve for transferring a pivot movement from the release lever 18 to the driver 17 (cf. FIGS. 4 and 5). The cam 17*c* projects from the curved section 17*a* and comprises a parking indentation 17*d* which is formed as an approximately cube-shaped cut-out in the cam 17*c* (cf. FIG. 5B). The parking indentation 17*d* serves for establishing a latch connection to the release lever 18 to arrest the pawl 16, as will be explained in more detail in the following.

As can be seen in FIG. 1, the plate-shaped pawl 16 is pivotably supported about a pivot axis 16*a* at an end at the base plate 21 of the housing 20 in that a pin 24 engages through an opening 16*b* of the pawl 16 and through an opening 21*c* formed in the base plate 21. A leg spring 26 is wound around the pin 24 and its first leg 25*a* contacts a driver 17 of the pawl 16 and its second limb 26*b* contacts the right side wall 20*b* of the housing 20.

In addition, FIG. 1 shows the release lever 18 of the motor vehicle lock 10 which is driven by a drive motor 22 via a band 22*a* (cf. FIG. 3A) and whose movement pivots the pawl 16 over the driver 17. For this purpose, the release lever 18 first has a curved arm 18*a* which is connected at an end disposed remote from the release lever 18 via a pin to the band 22*a* of the drive motor 22.

The release lever 18 is pivotably supported by a pin 32 which engages through an opening 18*b* of the release lever 18 about a pivot axis 18*c* (cf. FIG. 2) at the base plate 21 of the housing 20. A leg spring 34 having two legs 34*a*, 34*b* is arranged at the pin 32 and exerts a preloading force on the release lever 18. The first leg 34*a* of the leg spring 34 is fixedly connected to the base plate 21 of the housing 20 and the second leg 34*b* contacts a projection 18*d* of the release lever 18.

To transfer the pivot movement to the driver 17 of the pawl 16, the release lever furthermore has a driver cam 18*e* and a transport cam 18*f*. To pivot the pawl 16, the block-shaped transport cam 18*f* presses against the cam 17*c* of the driver 17 and to arrest the pawl, the transport cam 18*f* latches with the parking indentation 17*d* of the driver 17.

Furthermore, the release lever 18 has a blocking cam 18*g* which cooperates with the pawl 16 and which prevents the pawl 16 from leaving the blocking position or prelatching position (cf. FIG. 3B).

In the following description, the positions of the pawl 16 and of the catch 12 will be explained first as well as the opening process of the motor vehicle lock 10 with reference to FIG. 2.

In FIG. 2, the catch 12, the pawl 16 and the release lever 18 are shown purely schematically with their pivot axes 12*d*, 16*a*, 18*c* and their preloading forces. To prevent the catch 12 from pivoting into the open position N due to its preloading force, the preloading force of the pawl 16 acts in an opposite direction to the preloading force of the latch 12.

When the motor vehicle lock 10 locks the tailgate, e.g. during drive operation of the motor vehicle, the catch 12 is in the closed position L and the pawl 16 is in the blocking position A and the latching section 16*c* of the pawl 16 and the blocking section 14*a* of the jacket surface 14 cooperate (cf. FIG. 3A).

To unlock the striker, the release lever 18 is pivoted by the drive motor 22 against its preloading force, that is clockwise, until the driver cam 18*e* of the release lever 18 moves toward the driver 17. The driver 17 and accordingly the pawl 16 are pivoted by the release lever 18 until the pawl 16 leaves the blocking position A and the blocking section 14*a* of the jacket surface 14 and the latching section 16*c* of the pawl 16 move out of engagement. The catch 12 then pivots into the preclosing position M due to its preloading force.

The prelocking position M of the catch 12 serves, for example, as a security against an unlocking of the tailgate due to an accidental actuation of the motor vehicle lock 10. In the prelocking position, the fork section 12*a* engages through the eyelet of the striker and secures the striker. The pawl 16 is located in the prelatching position B in which the latching section 16*c* blocks the catch 12 via the prelatching section 14*b* of the jacket surface 14.

To release the striker, the release lever 18 is pivoted further by the drive motor 22, whereby the release lever 18 pivots the pawl 16 over the driver 17 out of the prelatching position B. The latching section 16*c* and the prelatching section 14*b* of the jacket surface 14 thereby move out of engagement and the catch 12 pivots due to its preloading force into the open position N in which the catch 12 releases the striker and unlocks the tailgate. Due to this opening of the catch 12 into the open position, the support section 14*c* of the jacket surface 14 moves onto the support surface 16*d* of the pawl 16 and pushes the pawl 16 in the blocking position D in which the pawl 16 cannot block the catch 12.

The operation of the pawl arresting will now be explained with reference to FIGS. 3 to 8.

FIG. 3A shows the catch 12 in the closed position L and the pawl 16 in the blocking position A. In this position, the fork section 12*b* of the catch 12 forms a peripherally closed opening with the cut-out 21*b* of the base plate 21 in which a striker, not shown, can be locked.

In FIG. 3A, the driver 17 can be clearly recognized with the driver edge 17*b* and the cam 17*c*. The driver edge 17*b* is arranged relative to the driver cam 18*e* of the release lever such that the driver edge 17*b* lies in a rotational path of the driver cam 18*e* about the pivot axis 18*c*, i.e. on a pivoting of the driver cam 18*e* about the pivot axis 18*c*, the driver cam 18*e* abuts the driver edge 17*b* and pushes the driver along the rotational path (cf. FIG. 4). In an analog manner, the cam 17*c* having the parking indentation 17*d* is arranged along a rotational path of the transport cam 18*f*.

FIG. 3B shows an enlarged rear view of the region of FIG. 3A marked by a circle. The same applies to FIGS. 4 to 8.

It can be recognized in FIG. 3B that the blocking cam 18*g* formed at the lower region of the release lever 18 contacts a projection 16*c* of the pawl 16. The blocking cam 18*g* is thus seated in the pivot path of the pawl 16 and prevents the pawl 16 from leaving the blocking position A before the blocking cam 18*g* is moved away.

Furthermore, the functionally effective contact of the pawl 16 and of the jacket surface 14 of the catch 12 is shown in the lower region of FIG. 3B. In this respect, the catch 12 is seated with the blocking section 14*a* on the latching section 16*c* of the pawl 16 and is held in the closed position L against its preloading force. If the pawl is pivoted out of the blocking position A, that is counter-clockwise, the blocking section 14*a* and the latching section 16*c* move apart and move out of engagement so that the pawl 16 no longer blocks the catch 12 in the closed position L.

In particular the cooperation between the driver edge 17*b* and the driver cam 18*e* of the release lever 18*b* at the start of the opening process is shown in FIG. 4. In this respect, the catch 12 is located in the closed position L and the pawl is located in the blocked position A.

The drive motor 22 first starts to rotate and shortens the band 22*a* in that it winds the band 22*a* around a band coil 22*b*, not shown. The release lever 18 is pulled up to the drive motor 22 via the arm 18*a* connected to the band 22*a* by the shortening of the band 22*a* (cf. FIG. 3A) and only the release lever 18 is pivoted clockwise, whereby the blocking cam 18*g* is pivoted away from the projection 16*e* of the pawl 16, as is shown in FIG. 4B. A pivoting of the pawl 16 out of the blocking position A is then possible (cf. in FIG. 5B with the blocking cam 18*g*).

After a specific pivot movement, e.g. of 11 degrees, the driver cam 18 abuts the driver edge 17*b* since the driver edge 17*b* lies along the rotational path of the driver cam 18*e*. If the release lever 18 is pivoted further by the drive motor 22, the driver cam 18*e* pushes the driver 17 over the driver edge 17*b* and the pawl 16 leaves the blocking position A.

The state is shown in FIG. 5A in which the pawl 16 has left the blocking position A and the jacket surface 14 and the pawl 16 are out of engagement. In accordance with the description of FIG. 2, the catch 12 should leave the closed position L due to its preloading force. However, this does not occur when an external force acts on the tailgate. The external force can e.g. be the weight of a snow layer collected on a vehicle tailgate. This weight counteracts the opening of the tailgate, whereby the catch 12 does not pivot out of the closed position L since the tailgate does not move into the open direction.

If the pawl 16 were to pivot back into the blocking position A due to its preloading force with a closed catch 12, the latching section 16*c* would engage the jacket surface 14 beneath the blocking section 14*a*, the catch 12 would be blocked by the pawl 16 and the opening process would be aborted in an undesired manner. In order nevertheless to enable the opening process in such cases, the pawl 16 is arrested by means of the pawl arresting (cf. FIG. 7B).

As FIG. 5B shows, the release lever 18 with the transport cam 18*f* presses for this purpose against an edge of the parking indentation 17*d* which is arranged in the cam 17*c* of the driver 17. Unlike the state shown in FIG. 4, the driver cam 18*c* does not press on the driver edge 17*b* (cf. FIG. 5A) because the pivot movement was transferred from the driver cam 18*e* to the transport cam 18*f*. Such a transfer is naturally optional.

In FIG. 6, the pawl 16 is pivoted further by the release lever 18. FIG. 6B in particular shows the position of the transport cam 18*f* in which the transport cam 18*f* is almost located within the parking indentation 17*d* (cf. FIG. 5B). On a further movement of the release lever 18 counterclockwise, the transport cam 18*f* slides into the parking indentation 17*d* (cf. FIG. 7B).

FIG. 7 shows the active pawl arresting, that is the state in which the pawl 16 is arrested by the latch connection between the transport cam 18*f* of the release lever and the parking indentation 17*d* of the driver 17. On the active pawl arresting, the pawl 16 is located in the release position C in which the pawl 16 releases the catch 12. In the release position C, the pawl 16 is simultaneously located in an overlifting position. This means that the pawl 16 is pivoted so far away from the catch 12 that the catch 12 does not latch with the pawl 16 on a pivoting out of the closed position.

In addition, the cam 17*c* of the driver 17 of the pawl 16 projects in the release position C out of a window formed in the right side wall 20*b*, whereby the housing 20 can be realized in a compact and symmetrical manner.

The latch connection is shown more exactly in FIG. 7B. In the latch connection, the transport cam 18*f* is arranged in the parking indentation 17*d* of the driver 17. The latch connection acts against the preloading force of the pawl 16 and the pawl 16 cannot pivot back into the blocking position. It is therefore prevented by the latch connection that the pawl 16 leaves the release position until the catch 12 has reached the open position N and the opening process of the motor vehicle lock 10 is also ensured on the action of an external force on the tailgate.

FIG. 8 shows the motor vehicle lock 10 with the catch 12 in the open position L and with the pawl 16 in the unblocking position D. This state is present at the end of the opening process as well as after releasing the pawl arresting.

As can be seen in FIG. 8A, the fork section 12*b* is retracted onto the base plate 21 of the housing 20 by the opening of the catch 12 so that the cut-out 21*b* of the base plate 21 is released.

The cooperation of the support section 14*c* and of the support surface 16*d* is shown in the lower region of FIG. 8B. To achieve this state, the link 14*d* is first moved onto the support surface 16*d* of the pawl 16 on the opening of the catch 12 and the arrested pawl 16 is thereby moved somewhat against its preloading force. This movement releases the latch connection between the transport cam 18*f* and the parking indentation 17*d*, as is shown in the upper region of FIG. 8B. The catch 12 rotates further until the support section 14*c* comes to lie on the support surface 16*d* and the pawl 16 is moved into the unblocking position D.

If the catch 12 is again moved into the closed position or preclosed position, the pawl 16 is pivoted by its preloading force into the blocking position or prelatching position to block the catch 12.

REFERENCE NUMERAL LIST

10 motor vehicle lock
12 catch
12*a* end face
12*b* fork section
12*c* opening
12*d*) pivot axis
12*e* projection
14 jacket surface
14*a* blocking section
14*b* prelatching section
14*c* support section
14*d* link
16 pawl
16*a* pivot axis
16*b* opening
16*c* latching section
16*d* support surface
16*e* projection
17 driver
17*a* section
17*b* driver edge
17*c* cam
17*d* parking indentation
18 release lever
18*a* arm
18*b* opening
18*c* pivot axis
18*d* projection
18*e* driver cam
18*f* transport cam
18*g* blocking cam
20 housing
20*a*, 20*b* side walls
21 base plate
21*a* opening
21*b* cut-out
21*c* opening
22 motor
22*a* band
24, 28, 32 pin
26, 30, 34 leg spring
26*a*, 30*a*, 34*a* first leg
26*b*, 30*b*, 34*b* second leg
A blocking position
B prelatching position
C release position
D unblocking position
L closed position
M preclosed position
N open position

The invention claimed is:

1. A motor vehicle lock having a pivotable catch with a jacket surface;

a pawl, which is acted on by a preloading force, and which is pivotable about a pawl pivot axis between a blocking position in which the pawl blocks the catch and an unlocking position in which the catch is unblocked, comprising a driver that projects from the pawl in a direction parallel to the pawl pivot axis, said driver comprising a driver edge and a first cam;

a release lever configured to pivot about a release lever pivot axis and transfer pivot movement to the pawl for pivoting the pawl about the pawl pivot axis against the preloading force, the release lever comprising a second cam and a transport cam; and an arresting device for arresting the pawl in a release position in which it releases the catch, with a part of the arresting device being formed by the release lever;

wherein the driver edge lies in a rotational path of the second cam about the release lever pivot axis, and wherein the first cam lies in a rotational path of the release lever transport cam about the release lever pivot axis.

2. The motor vehicle lock in accordance with claim 1, wherein the release position is located between the blocking position and the unblocking position.

3. The motor vehicle lock in accordance with claim 1 wherein, in the release position, the pawl is located in an overlifting position in which it allows a complete opening of the catch.

4. The motor vehicle lock in accordance with claim 1, wherein the catch moves into functionally effective contact with the pawl only via its jacket surface.

5. The motor vehicle lock in accordance with claim 1, wherein the catch has a link for releasing the arresting device from the release position.

6. The motor vehicle lock in accordance with claim 5, wherein the link is arranged at the jacket surface of the catch.

7. The motor vehicle lock in accordance with claim 1, wherein the transport cam is configured to cooperate with the first cam to pivot the pawl about the pawl pivot axis into the unblocking position.

8. The motor vehicle lock in accordance with claim 7, wherein the arresting device has a latch connection between the cam of the pawl and the transport cam.

9. The motor vehicle lock in accordance with any one of the claim 7, wherein the second cam is configured to pivot the pawl out of the blocking position.

10. The motor vehicle lock in accordance with claim 1, wherein the jacket surface of the catch has a blocking section which cooperates in the blocking position with a latching section of the pawl;

a prelatching section which cooperates in a prelatching position with the latching section of the pawl; and a support section which cooperates in the unblocking position with a support surface of the pawl.

11. The motor vehicle lock in accordance with claim 10, wherein the blocking section, the prelatching section and the support section are arranged one after the other at the jacket surface.

12. The motor vehicle lock in accordance with claim 10, wherein the release lever has a blocking cam which blocks the pawl in the blocking position and/or in the prelatching position against a pivoting against the preloading force in at least one of the blocking position and the prelatching position.

13. The motor vehicle lock in accordance with at least one of the preceding claims claim 1, wherein, in the release position, a part of the pawl projects through a window which is formed in a housing of the motor vehicle lock.

* * * * *